US007134769B2

(12) United States Patent
Rohlfing et al.

(10) Patent No.: US 7,134,769 B2
(45) Date of Patent: Nov. 14, 2006

(54) LANTERN, PREFERABLY FOR USE ON BOARD SHIPS, IN PARTICULAR LEISURE CRAFT

(75) Inventors: Ralph Rohlfing, Weyhe (DE); Wolfgang Serfass, Bremen (DE)

(73) Assignee: Aqua Signal Aktiengesellshaft (DE)

( * ) Notice: Subject to any disclaimer, the term of this patent is extended or adjusted under 35 U.S.C. 154(b) by 171 days.

(21) Appl. No.: 10/831,940

(22) Filed: Apr. 26, 2004

(65) Prior Publication Data

US 2004/0252511 A1 Dec. 16, 2004

(30) Foreign Application Priority Data

Apr. 26, 2003 (DE) ..... 103 18 932

(51) Int. Cl.
*F21V 5/04* (2006.01)
*F21V 29/00* (2006.01)
*B63B 45/00* (2006.01)

(52) U.S. Cl. ..... 362/331; 362/294; 362/335; 362/477; 362/522; 362/545; 362/547

(58) Field of Classification Search ..... 362/331, 362/267, 475, 477, 294, 326, 335, 373, 520–522, 362/545, 547
See application file for complete search history.

(56) References Cited

U.S. PATENT DOCUMENTS

| | | | | |
|---|---|---|---|---|
| 1,133,536 | A * | 3/1915 | Chase | 362/477 |
| 3,927,314 | A | 12/1975 | Wiggerman | |
| 5,495,147 | A | 2/1996 | Lanzisera | |
| 5,769,532 | A | 6/1998 | Sasaki | |
| 6,030,099 | A | 2/2000 | McDermott | |
| 6,086,220 | A | 7/2000 | Lash | |
| 6,254,262 | B1 * | 7/2001 | Crunk et al. | 362/331 |
| 6,461,024 | B1 * | 10/2002 | Becker et al. | 362/331 |
| 6,461,029 | B1 * | 10/2002 | Gronemeier et al. | 362/545 |
| 6,466,188 | B1 | 10/2002 | Cato | |
| 6,565,239 | B1 * | 5/2003 | Rizkin et al. | 362/373 |
| 6,676,284 | B1 * | 1/2004 | Wynne Willson | 362/555 |
| 6,905,228 | B1 * | 6/2005 | Takeyasu et al. | 362/545 |
| 2004/0057234 | A1 * | 3/2004 | Mohacsi | 362/231 |

FOREIGN PATENT DOCUMENTS

| | | |
|---|---|---|
| DE | 201 01 295 U1 | 5/2001 |
| EP | 0 976 971 A1 | 7/1999 |
| GB | 537471 | 6/1941 |

OTHER PUBLICATIONS

Europaischer Teilrecherchenbericht (Aug. 15, 2005) (European Search Report) EP 04 00 9825.

* cited by examiner

*Primary Examiner*—Alan Cariaso
(74) *Attorney, Agent, or Firm*—Laurence P. Colton; Powell Goldstein LLP

(57) ABSTRACT

The invention relates to a lantern, preferably for use aboard ships, in particular leisure vessels, which has a housing, at least one illuminant and a light-permeable cover.

Figure 1:
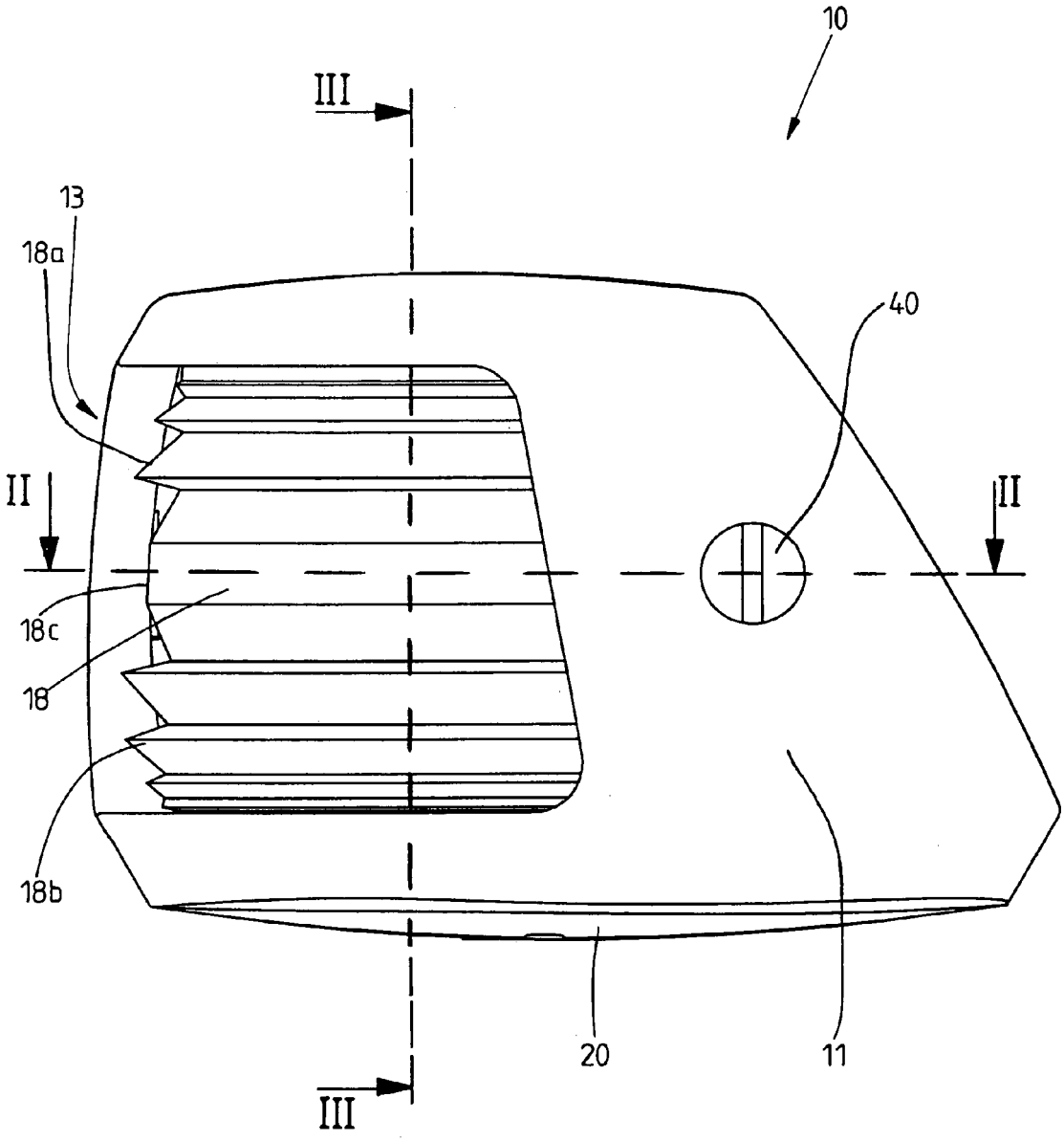

According to the invention, at least one LED is provided as the illuminant and is associated with a beam baffler.

11 Claims, 7 Drawing Sheets

LANTERN, PREFERABLY FOR USE ON BOARD SHIPS, IN PARTICULAR LEISURE CRAFT

The invention relates to a lantern, preferably for use on board ships, in particular on leisure craft, with a housing, at least one illuminant and a light-permeable cover.

Lanterns of the aforementioned type are used for a wide variety of purposes, such as luminaries used as markers, danger signals, obstruction signals or navigation lights. The invention relates to lanterns in general, and in particular to navigation lights on board ships or leisure craft. A preferred area of application are lanterns which meet the strict US regulations concerning "A-16 Electric Navigation Lights" as amended in June 1997 and published by the American Boat and Yacht Council Inc. The light of the lantern must attain a certain minimum distance in the essentially horizontal direction. Other requirements stipulate, for example, that certain defined colors must be adhered to.

A big problem of particular relevance to leisure boating is the dependability of the on-board lanterns. Lanterns are rarely activated on a regular basis. Most journeys are made during daylight hours. The existing illuminants have a very limited lifetime and are sensitive to humidity and jolting movements. Lighting systems may fail unexpectedly even though the theoretical lifetime of the employed illuminants is far from over. The present invention is intended to provide a reliable lantern. To this end the lantern according to the invention is characterized by the following features.

a) at last one LED (light-emitting diode) is provided as the illuminant, b) the illuminant is assigned a beam baffler.

One disadvantage of LEDs is their low light intensity while exhibiting good emitting efficiency. The beam baffler concentrates and focuses the light of the LED preferably so that the existing light is optimally employed for the designated purpose. In most cases, light emission is essentially desired in the region of a horizontal plane. The beam baffler bundles the light in one plane. Preferably an additional bounding or bundling of light in a defined range is provided, for example a limited sector of a horizontal plane, as provided in the aforementioned US regulations.

The beam baffler can be provided in the form of a mirror or as a solid prism. Preferred here is an essentially symmetric design of the beam baffler with the illuminant arranged in a plane of symmetry or in the main axis of the beam baffler.

The beam baffler is preferably an essentially semi-cylindrical, prism-like, solid lens with many or all of the following characteristics:

a) the main axis—based on the emitted light—of the beam baffler is intersected by a perpendicular axis of curvature, b) an outer surface of the beam baffler extends semi-cylindrically about the aforementioned axis of curvature for it, c) said axis of curvature is at the same time the axis of curvature for a semi-cylindrical inner surface of the beam baffler, d) the semi-cylindrical outer surface and the semi-cylindrical inner surface run essentially parallel to one another and are preferably intersected concentrically by the main axis of the beam baffler, e) the beam baffler is solid between its outer surface and inner surface, f) when light is emitted in a preferably horizontal plane, the axis of curvature extends essentially in the vertical direction, g) the outer surface and inner surface extend to a wall which runs essentially transverse to the main axis, h) provided in the wall running perpendicular to the main axis is a recess, into which the illuminant partially enters, i) the recess is limited by the semi-cylindrical inner surface, a transverse flat top wall and a like bottom wall, j) in the direction of the axis of curvature, a top side lies outside of the top wall and a bottom side lies below the bottom wall of the beam baffler, k) top side and bottom side each extend between the semi-cylindrical outer surface and the wall running transverse to the main axis, l) top side and bottom side are configured essentially in the shape of a reference cone so that together they have an essentially V-shaped cross section, being spaced far apart from each other in the region of the outer surface and at a small distance from each other in the vicinity of the illuminant.

The LED can be either white or colored. Depending on the application at hand, red or green LEDs are preferred. White LEDs can be provided with a filter layer, in particular vacuum coated, in order to filter out blue light. However, the desired colors can also be achieved by coloring the beam baffler or the light-permeable cover.

LEDs exhibit a considerably longer lifetime than conventional illuminants (light bulbs, halogen lamps) and can therefore also be installed in the housing without being designed for replacement. The construction of the lantern can therefore save on overall cost. This also makes it easier to provide protection against special climactic conditions.

Advantageously, an LED is provided as the illuminant. For the first time sufficiently high-intensity LEDs have been developed and are now available. In particular, LEDs of the type LXHL-PD01 Luxeon Emitter (hemispherical dome) from the manufacturer LUMILEDS Lighting, LLC, San Jose, Calif., USA are used. Using only one LED as the illuminant makes it possible to achieve a particularly small and compact housing. The same applies to any requirements concerning electronics.

According to a further idea of the invention, the illuminant is aligned with the principal beam directed perpendicular to a rear wall of the housing. LEDs usually emit a cone of light. Its central axis, or cone axis, runs perpendicular to the rear wall of the housing. Preferably the beam baffler also extends with its main alignment or symmetrical plane perpendicular to the rear wall. The beam baffler preferably focuses the light in a plane perpendicular to the rear wall. A further limitation of the emitted light to a defined sector is preferably represented by shields for restricting and shadowing the light emitted by the illuminant. The shield can be assigned to the beam deflector, for example on the outside of the latter. The housing can also be used to shadow the emitted light by having light-impermeable regions.

According to another idea of the invention, the illuminant is assigned a cooling element. Preferably the at least one LED is arranged on a cooling element, such as a plate with good heat-conducting properties, in particular one made of metal. An intermediate layer can be provided between the cooling element and the illuminant that is also designed with good heat-conducting properties and which can have electronic components for its control. In particular, the cooling element has a flat design and extends perpendicular to the main axis of the illuminant's light emission. The cooling element can also lie against the rear wall of the housing.

In an advantageous development, an electronic circuit for control of the at least one LED is arranged in an auxiliary housing. The auxiliary housing is attached onto the housing and has a cup-like configuration. Here a base of the cup extends parallel to the rear wall of the housing. The base wall of the cup can have bore holes in order to accommodate screws for connecting the housing and the auxiliary housing.

The preferred possibility of attachment is to affix the lantern to a wall on board a ship. A centrally threaded connection is provided for this. Housing and auxiliary housing have flush, continuous bore holes, so that a screw can hold the auxiliary housing (cup base wall) to the wall and the housing to the auxiliary housing. The particular advantage of the auxiliary housing is that it allows one to use conventional lantern housings as known in conjunction with conventional illuminants. This also physically separates the LED from any lost heat occurring in the region of the electronic circuitry. The electronic circuit is preferably completely encapsulated in the auxiliary housing.

According to a further idea of the invention, the light-permeable cover is configured as a Fresnel lens with stepped regions. The steps can be located on the outer side of the cover, preferably with an upper stepped region, a middle and essentially flat region, and a lower stepped region. Here the levels formed by the steps run essentially perpendicular to the rear wall. The surfaces within each step run about an axis parallel to the rear wall. When the desired light is emitted in a horizontal plane, said axis extends in the vertical direction. By virtue of the stepped regions, the light is compressed parallel to said axis, meaning that little or no light is emitted above and below the defined angle.

In an advantageous development, the light-permeable cover extends at least with its edge regions into the housing. Here the areas of the latter close to the cover are adapted to its contour. When the light-permeable cover has a stepped outer surface, the housing can be designed as having the negative shape of the cover in the region of transition from the housing to the light-permeable cover.

Pursuant to a further alternative of the invention, the light-permeable cover is configured as having a smooth inner and outer surface. In particular the smooth outer surface allows for a maintenance-friendly design of the lantern and can be easily cleaned.

According to a further idea of the invention, an electronic circuit is provided to compensate for different supply voltages such that any supply voltage lying between a minimum voltage and a maximum voltage can be connected to the lantern, with the maximum voltage being at least 1.5 times greater than the minimum voltage. The supply voltage can be transferred or adapted to a desired value by the circuitry. As an alternative, the circuit can provide an essentially direct current for the LED. This allows the lantern to be used independently of different supply voltages. For example, leisure craft are provided with an on-board supply voltage of 12 volts or 24 volts.

Figure 2:
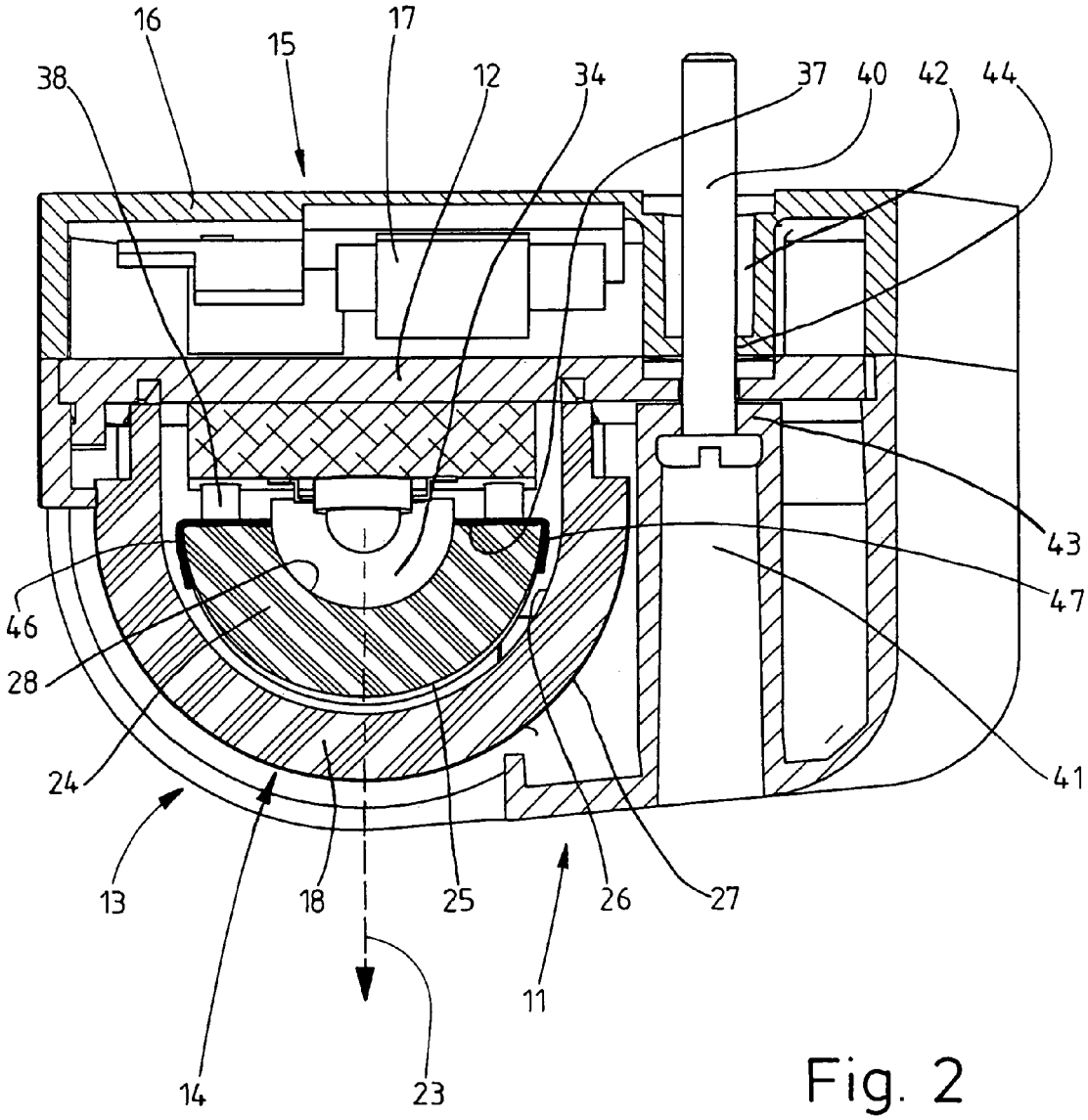
Figure 3:
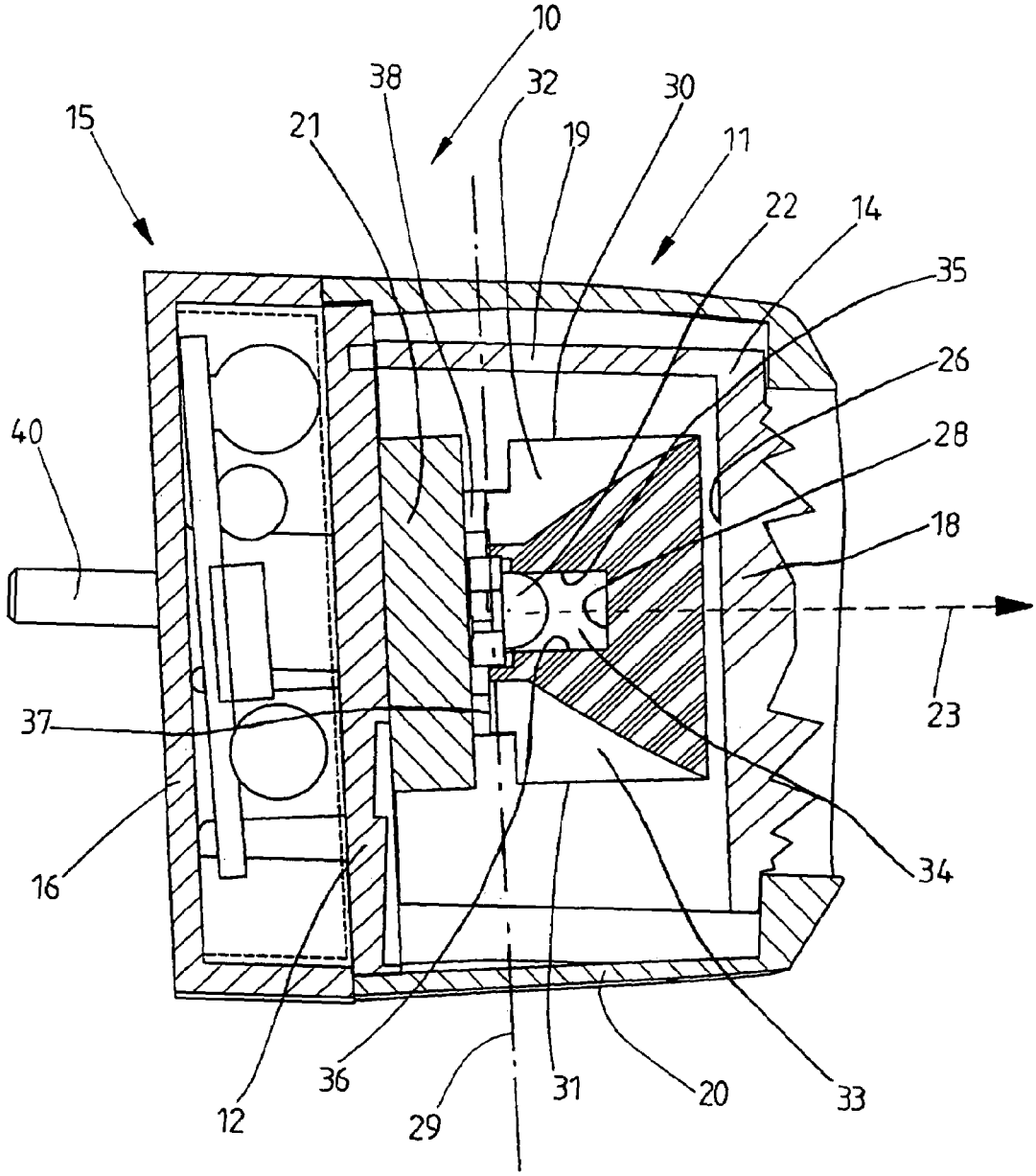
Figure 4:
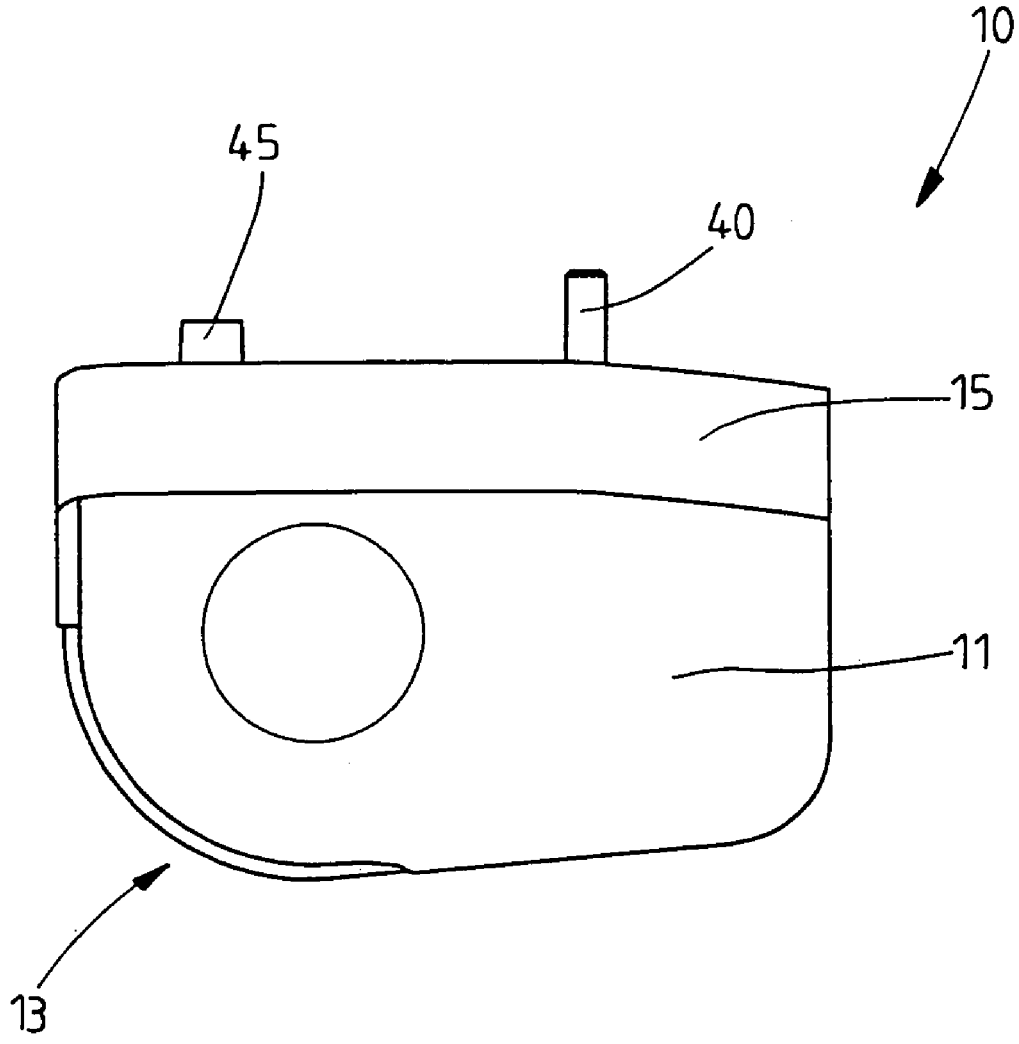
Figure 5:
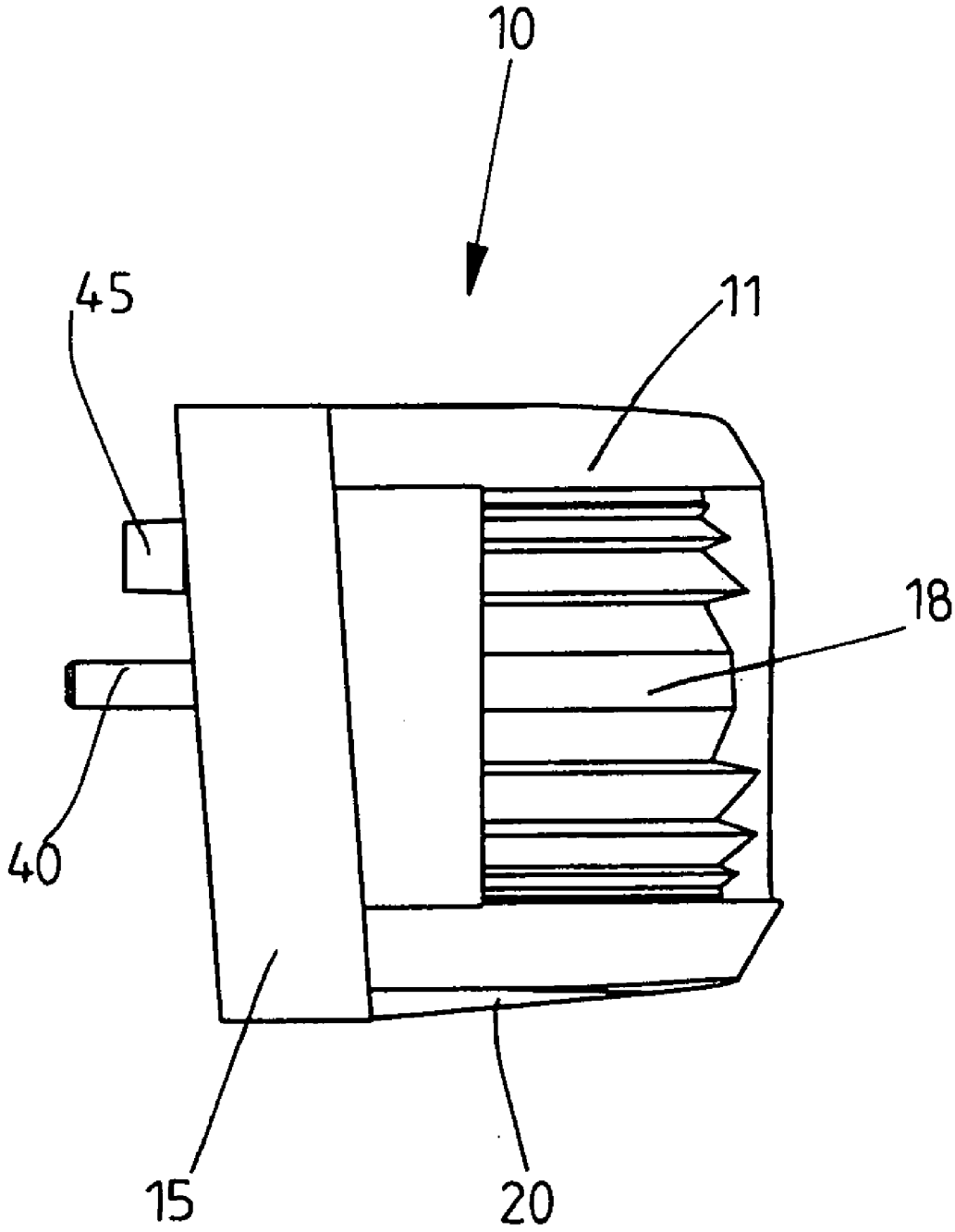
Figure 6:
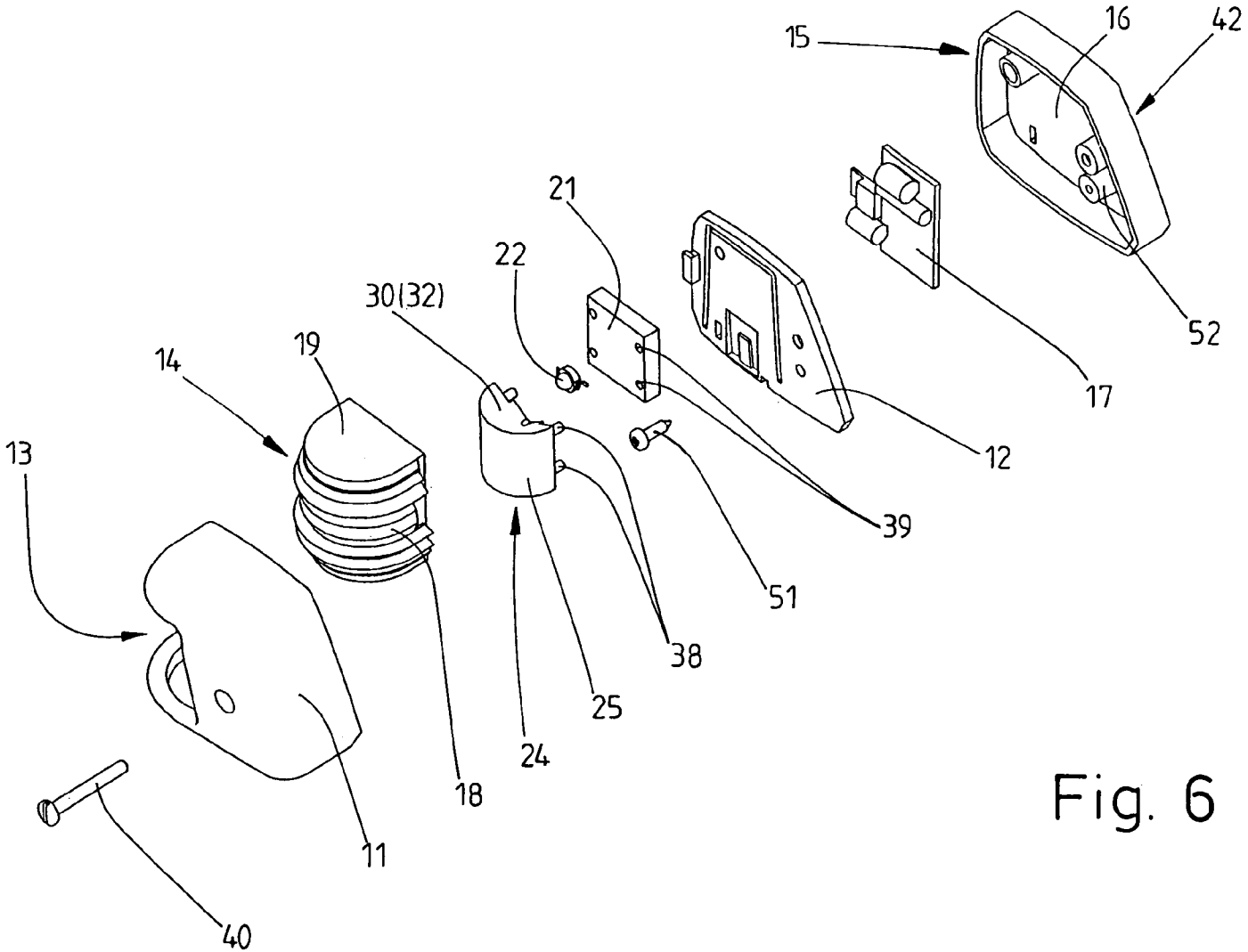
Figure 7:
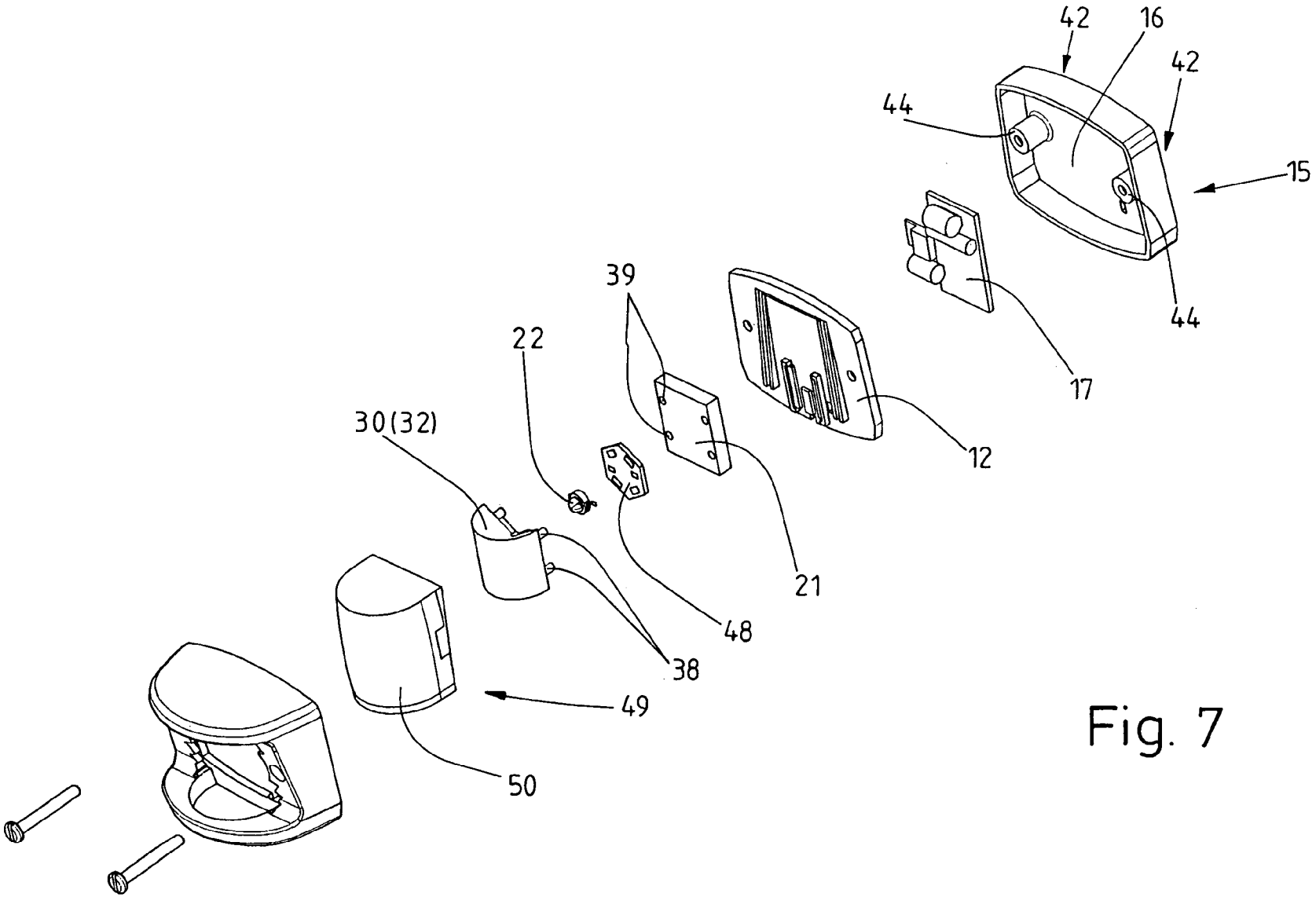

Other features of the invention are disclosed in the claims and the following description. Advantageous exemplary embodiments will be explained in more detail below with the help of drawings, which show:

FIG. 1 a side view of a lantern according to the invention with an asymmetrical housing and a light-permeable cover with a stepped outer surface, FIG. 2 a sectional view through the lantern pursuant to FIG. 1 along the line II—II, FIG. 3 a sectional view through the lantern pursuant to FIG. 1 along the line III—III, FIG. 4 a top view of the lantern pursuant to FIG. 1, FIG. 5 a side view of the lantern pursuant to FIG. 1, with a image plane parallel to the image plane in FIG. 3, FIG. 6 exploded view of the individual parts of the lantern pursuant to FIG. 1, FIG. 7 a somewhat varied model of the lantern in exploded view analogous to FIG. 6, but with a symmetric housing and a light-permeable cover having a smooth outer surface.

Represented in the Figures is a lantern 10 used as a navigation light for the port side of a leisure craft in accordance with the regulations set forth in "A-16 Electric Navigation Lights", volume 7/97, published by the American Boat and Yacht Councel Inc. In particular, the regulations relate to the range of the lantern, its beam control and the colors employed.

The lantern 10 has a housing comprising a tub-like or cup-like front housing 11 and rear wall 12. The front housing is provided with an aperture 13 opposite to the rear wall 12, with a light-permeable cover 14 being fitted into said aperture 13.

Attached to the outer side of the rear wall 12 is a cup-like auxiliary housing 15 having a cup base 16 parallel to the rear wall 12. The cavity formed by the auxiliary housing 15 between the rear wall 12 and cup base 16 is filled at least in part by electronic circuitry 17 for controlling at least one illuminant. The cavity and/or the circuitry can be encapsulated, thereby enhancing stability and protection against moisture.

The light-permeable cover 14, which forms a hollow space open at one side, is made of plastic or glass and has a semi-circular circumferential wall 18 and a semi-circular shaped top wall 19. The hollow space thus formed is closed to the rear by the rear wall 12 and on the bottom by a bottom side 20 of the front housing 11.

The outer side of the wall 18 is configured in the manner of a Fresnel lens, namely with a stepped upper region 18*a*, a stepped lower region 18*b* and a smooth middle region 18*c*.

Provided inside the cover 14 on the rear wall 12 is a flat (here: rectangular) cooling element 21. Arranged as the illuminant on the cooling element 21 is a single LED 22. Its principal beam direction—arrow 23—runs perpendicular to the rear wall 12, dividing the middle of the semicircular-shaped cross section of the circumferential wall 18 into two quarter-sections, see especially FIG. 2.

Arranged between the LED 22 and the cover 14 is a beam baffler; in the present example it is a solid, prism-like lens 24. Its outer surface 25, directed away from the LED 22, runs in a partially cylindrical manner, in particular semi-cylindrical and essentially parallel to the cover 14, namely parallel to the smooth inner surface 26 and/or outer surface 27 of the encompassing wall 18.

Running parallel or at least essentially parallel to the outer surface 25 is an inner surface 28 of the lens 24, i.e. likewise having a semicircular cross section. With the lantern 10 having an essentially vertically arranged rear wall 12 and an essentially horizontally arranged bottom side 20, an axis of curvature 29 for the outer surface 25 (and inner surface 28) of the lens 24 (analogous for the cover 14) runs in the vertical direction. In fact, the rear wall 12 is slightly inclined with respect to a vertical direction, as is the bottom side 20 with respect to a horizontal direction. The axis of curvature 29 runs parallel to the rear wall 12, see FIG. 3.

The beam is controlled by the lens 24 by means of essentially two creative measures. The top side 30 and bottom side 31 of the lens 24 each have a concavity 32, 32 (depression) with a semi-conical cross section. Proceeding from the outer surface 25, the depression has its deepest point, and thus the closest point to the principal beam direction—arrow 23—in the region of the axis of curvature 29 or at a slight distance therefrom in the region closest to the LED. The top side 30 (or the concavity 32) forms an interface for the light, which it refracts, thus resulting in a focusing essentially parallel to a (here: horizontal) plane along the principal beam direction 23 and perpendicular to the axis of curvature 29. This applies analogously to the interface of the bottom side 31.

Furthermore, in the present exemplary embodiment a recess 34 is provided in the lens 24 near the LED 22. The recess 34 is delimited by a semicircular, flat top wall 35, a bottom wall 36 running parallel thereto and a circumferential wall running transverse thereto, which runs parallel to the outer surface 25 and is identical to the aforementioned inner surface 28. A large portion of the light emitted by the LED is reflected by the top wall 35 and bottom wall 36 in the direction of the inner surface 28. The non-reflected portions are reflected at the top side 30 and bottom side 31 of the concavities 32, 33. The lens 24 focuses the light in a particularly appropriate manner for achieving the greatest possible light intensity or range in the region of a plane perpendicular to the axis of curvature 29.

In order to avoid heat accumulation between the LED 22 and the lens 24, the latter has four spacers in the region of a rear wall 37 which abut the cooling element 21 or which are inserted into corresponding bore holes 39 in the cooling element 21, even with a small part of their length, as shown in particular in FIG. 6. The aforementioned recess 34 is incorporated into the wall 37.

The LED 22 comes from the manufacturer Lumiled Lighting LLC, San Jose, Calif., USA, model LXHL-PD01 Luxeon Emitter in the color white. The red color required for a navigation light on a port side of a ship is achieved by the red coloring of the cover 14. As an alternative, the LED 22 or the lens 24 can be red.

The lantern 10 is provided with just one screw 40 for being attached to a vessel's side. The screw extends through the corresponding bore holes in the front housing 11, rear wall 12 and the cup base 16. The screw 40 thus serves at the same time in creating a fixed connection between the auxiliary housing 15 and the rear wall 12. In order to prevent moisture from entering the housing or the auxiliary housing 15, the front housing 11 and the cup base 16 have cup-like depressions 41, 42, whose butt end 43, 44 abut the rear wall 12. The latter can have recesses for sealing material in the region of the butt ends 43, 44.

To ensure an unalterable position of the lantern 10 on a vessel's side, the lantern 10 has on the outside of the cup base 16 a peg 45 arranged parallel to the screw 40. The peg 45 is inserted into a prepared bore hole (not shown), thus preventing any twisting of the lantern 10 about the screw 40, see FIGS. 4 and 5.

Additional shields can be provided for the lateral restriction of the emitted light. Pursuant to FIG. 2, angle-section shields 46, 47 are provided on the lens 24 in the region of the wall 37, each in the region of transition to the outer surface 25 46, 47. Instead of the shields 46, 47, it is also possible to provide correspondingly configured, light-impermeable, e.g. vaporized, coatings to the lens 24.

The front housing 11 has an asymmetrical configuration with a laterally offset aperture 13, see in particular FIGS. 4 and 6, with a cover 14 of symmetrical form. Its suitability as a navigation light on a boat's port side is thus achieved merely by the outer shape of the housing. For use as a starboard lantern, a housing correspondingly designed in its mirror image (with auxiliary housing) is provided.

A symmetrical housing is shown in FIG. 7. The housing here is for a navigation light on the stern of a boat. The cooling element 21, LED 22, lens 24 and cover 14 can be designed identically to those of the aforementioned exemplary embodiment of a port-side navigation lantern. Due to the symmetrical housing design, two screws can be provided here which are screwed into the side of a boat. Another special feature, shown in FIG. 7, is an additional circuit board 48 between the LED 22 and the cooling element 21. The circuit board 48 preferably consists of a good heat-conducting material. Additional components can be provided on the circuit board for LED control.

The light-permeable cover shown in FIG. 7 has been labeled with the number 49 because a semicircular outer surface 50 has a smooth design. This is an alternative to the cover 14 in FIG. 6 which is stepped on its outer side in the manner of a Fresnel lens. In fact, both varieties of covers 14, 49 can be used for all lantern types discussed. The actual selection is made on the basis of considerations regarding range, light focusing, light intensity, etc.

Another special feature can also be seen in FIG. 6. It shows a screw 51 which fixes the rear wall 12 to the cup-like auxiliary housing 15. A corresponding threaded receptacle 52 extends from the cup base 16 to the rear wall 12, analogous to the depression 42 in FIG. 2.

List of designations

| | |
|---|---|
| 10 | lantern |
| 11 | front housing |
| 12 | rear wall |
| 13 | aperture |
| 14 | cover |
| 15 | auxiliary housing |
| 16 | cup base |
| 17 | electronic circuit |
| 18 | circumferential wall |
| 18a | upper region |
| 18b | lower region |
| 18c | middle region |
| 19 | top wall |
| 20 | bottom side |
| 21 | cooling element |
| 22 | LED |
| 23 | arrow |
| 24 | lens |
| 25 | outer surface |
| 26 | inner surface |
| 27 | outer surface |
| 28 | inner surface |
| 29 | axis of curvature |
| 30 | top side |
| 31 | bottom side |
| 32 | concavity |
| 33 | concavity |
| 34 | recess |
| 35 | top wall |
| 36 | bottom wall |
| 37 | wall |
| 38 | spacer |
| 39 | bore holes |
| 40 | screw |
| 41 | depression |
| 42 | depression |
| 43 | butt end |
| 44 | butt end |
| 45 | peg |
| 46 | shield |
| 47 | shield |
| 48 | circuit board |
| 49 | cover |
| 50 | outer surface |
| 51 | screw |
| 52 | receptacle |

The invention claimed is:

1. A lantern (10) preferably for use on board ships, in particular on leisure craft, with the lantern having a housing, at least one illuminant and a light-permeable cover (14), the lantern comprising:

a) at least one LED (22) provided as the at least one illuminant; and b) a beam baffler assigned to the at least one illuminiant, the beam baffler having an essentially partially cylindrical, prism-like and solid lens and a main axis, wherein i) the main axis of the beam baffler, based on the emitted light, is intersected by an axis of curvature perpendicular to main axis;

ii) an outer surface of the beam baffler extends in a partially cylindrical manner about the axis of curvature;

iii) the axis of curvature is at the same time the axis of curvature for a partially cylindrical inner surface of the beam baffler;

iv) the beam baffler is solid between the outer surface and the inner surface;

v) when light is emitted in as horizontal a plane as possible, the axis of curvature extends essentially in the vertical direction;

vi) the outer surface and the inner surface extend to a wall that runs essentially transverse to the main axis;

vii) provided in the wall running transverse to the main axis is a recess, into which the illuminant at least partially enters;

viii) the recess is limited by the inner surface, a flat top wall transverse to the inner surface and a flat bottom wall transverse to the inner surface;

ix) in the direction of the axis of curvature, a top side lies outside of the top wall and a bottom side lies below the bottom wall of the beam baffler:

x) the top side and the bottom side each extend between the outer surface and the wall running transverse to the main axis; and xi) the top side and the bottom side each are configured essentially in the shape of a reference cone so that together the top side and the bottom side have an essentially V-shaped cross-section, being spaced far apart from each other in the region of the outer surface and at a small distance from each other in the vicinity of the illuminant.

2. The lantern according to claim 1, wherein exactly one LED (22) is provided as the illuminant.

3. The lantern according to claim 1, wherein the illuminant is arranged with a principal beam direction (arrow 23) directed perpendicular to a rear wall (12) of the housing.

4. The lantern according to claim 1, further comprising a shield for the purpose of limiting and shadowing the light emitted by the illuminant.

5. The lantern according to claim 1, further comprising a cooling element assigned to the illuminant.

6. The lantern according to claim 1, further comprising an electronic circuit (17) for controlling the LED (22) arranged in an auxiliary housing (15).

7. The lantern according to claim 1, wherein the light-permeable cover (14) is configured as a Fresnel lens with stepped regions.

8. The lantern according to claim 1, wherein the light-permeable cover (14) is configured with a smooth inner and outer surface.

9. The lantern according to claim 1, wherein the light-permeable cover (14) is inserted in the housing and the housing conforms to an outer contour of the permeable cover (14) in the vicinity of the permeable cover (14).

10. The lantern according to claim 1, characterized in that the outer surface and the inner surface run essentially parallel to one another and are intersected concentrically by the main axis of the beam baffler.

11. A lantern (10), preferably for use on board ships, in particular leisure craft, with a housing, at least one illuminant and a light-permeable cover (14), comprising:

a) at least one LED (22) provided as the illuminant; and b) a beam baffler assigned to the illuminant;

wherein i) the housing has a tub-like or cup-like front housing (11) and a rear wall (12);

ii) the front housing (11) has an aperture (13) opposite to the rear wall (12), with the light-permeable cover (14) being fitted into the aperture (13);

iii) a flat cooling element is provided on the rear wall (12);

iv) the LED (22) is arranged on the cooling element (21), with or without a circuit board (48) between the LED (22) and the cooling element (21);

v) the beam baffler is a solid lens (24);

vi) the lens (24) has spacers in the region of a rear wall (37) that abuts the cooling element (21): and vii) the spacers are inserted at least partially into corresponding bore holes (39) in the cooling element (21).

* * * * *